US010566132B2

(12) United States Patent
Suzuki

(10) Patent No.: US 10,566,132 B2
(45) Date of Patent: Feb. 18, 2020

(54) ELECTROMAGNETIC SWITCH FOR ENGINE STARTER

(71) Applicant: DENSO CORPORATION, Kariya, Aichi-pref. (JP)

(72) Inventor: Yoshiaki Suzuki, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/948,945

(22) Filed: Nov. 23, 2015

(65) Prior Publication Data

US 2016/0148739 A1 May 26, 2016

(30) Foreign Application Priority Data

Nov. 25, 2014 (JP) ..... 2014-237709

(51) Int. Cl.

| | |
|---|---|
| ***H01F 5/04*** | (2006.01) |
| ***H01F 27/32*** | (2006.01) |
| ***H01H 50/44*** | (2006.01) |
| ***H01F 7/16*** | (2006.01) |
| ***H01H 51/06*** | (2006.01) |
| ***F02N 11/08*** | (2006.01) |
| *H01H 51/12* | (2006.01) |
| *F02N 15/06* | (2006.01) |

(52) U.S. Cl.

CPC ..... *H01F 27/325* (2013.01); *F02N 11/087* (2013.01); *H01F 7/1607* (2013.01); *H01H 50/443* (2013.01); *H01H 51/065* (2013.01); *F02N 15/065* (2013.01); *F02N 15/067* (2013.01); *H01F 2007/1692* (2013.01); *H01H 51/12* (2013.01); *H01H 2050/446* (2013.01)

(58) Field of Classification Search

CPC ..... H01F 2007/1692; H01F 27/325

See application file for complete search history.

(56) References Cited

U.S. PATENT DOCUMENTS

| | | | |
|---|---|---|---|
| 2009/0183595 | A1 | 7/2009 | Niimi |
| 2012/0049989 | A1 | 3/2012 | Niimi et al. |
| 2013/0025407 | A1 | 1/2013 | Niimi |

FOREIGN PATENT DOCUMENTS

| | | | |
|---|---|---|---|
| JP | 2010-230013 | A | 10/2010 |
| JP | 5578257 | B1 | 8/2014 |
| JP | 2014-163370 | A | 9/2014 |

OTHER PUBLICATIONS

Machine translation of JP2015-017563.*

* cited by examiner

*Primary Examiner* — Ramon M Barrera
(74) *Attorney, Agent, or Firm* — Oliff PLC

(57) ABSTRACT

An electromagnetic switch includes a first and a second solenoid arranged in alignment in an axial direction of a housing and brings a pinion into mesh with a ring gear of an engine and close main contacts in a power supply circuit for an electric motor which cranks the engine. A retainer is provided which extends from a first bobbin of the first solenoid at least to a location of an air gap formed in a magnetic circuit of the second solenoid. The retainer holds a portion of a lead wire extending from a bobbin of the first solenoid at least in a range between the bobbin and the air gap, thereby minimizing inclination or deflection of the lead wire when the first and second solenoids are fabricated within the housing, thus facilitating the ease with which the first and second solenoids are mounted in place in the housing.

7 Claims, 8 Drawing Sheets

ELECTROMAGNETIC SWITCH FOR ENGINE STARTER

CROSS REFERENCE TO RELATED DOCUMENT

The present application claims the benefit of priority of Japanese Patent Application No. 2014-237709 filed on Nov. 25, 2014, the disclosure of which is incorporated herein by reference.

BACKGROUND OF THE INVENTION

1. Technical Field

This disclosure relates generally to an electromagnetic switch which is used in a starter working to start an engine and equipped with a first solenoid which moves a pinion of the starter toward a ring gear joined to the engine and a second solenoid which opens or closes main contacts installed in a motor circuit.

2. Background Art

Tandem Solenoid (TS) starters are known which are engineered as an engine starter and equipped with two solenoids; one working to push a pinion to a ring gear of the engine, and the second working to open or close main contacts installed in a motor circuit.

For instance, Japanese Patent No. 5578257 teaches an engine starter which is equipped with a first solenoid and a second solenoid. The first solenoid works to use a magnetic attraction produced by a first coil to move the pinion to the ring gear. The second solenoid works to use a magnetic attraction produced by a second coil to close the main contacts. The engine starter is capable of controlling the operations of the first and second solenoids independently from each other.

The first and second solenoids are arranged in series within a single frame. The first coil is mounted close to one of ends of the frame (which will also be referred to as a first end below), while the second coil is mounted close to the other end side of the frame (which will also be referred to as a second end below). One of two lead wires of the first coil (which will also be referred to as a first coil lead wire below) passes radially inside the second coil and extends outside the second end of the frame. A resinous cover is attached to the second end of the frame to close an opening of the frame. The resinous cover has installed therein a power supply terminal to which an end of the first coil lead wire is joined electrically and mechanically.

The above structure does not arrange the first coil lead wire radially outside the second coil, thus enabling an air gap between the second coil and the frame to be minimized, which enhances the dissipation of heat, as generated from the second coil when energized, from the frame.

The first coil of the above structure is wound around a first bobbin. The first bobbin has a first flange and a second flange which are opposed to each other in an axial direction of the starter. The first flange is closer to the first end of the frame, while the second flange is closer to the second end of the frame. Similarly, the second bobbin has a first flange and a second flange which are opposed to each other in the axial direction of the starter. The first flange is closer to the first end of the frame, while the second flange is closer to the second end of the frame. The first bobbin also has a lead-wire outlet formed in the second flange of the first bobbin. The first coil lead wire is retained by the lead-wire outlet and extends axially from the lead-wire outlet. The lead-wire outlet does not extend radially inside the second coil. Specifically, the lead-wire outlet has one of ends thereof placed in contact with the first flange of the second bobbin. In other words, the first coil lead wire is retained by the lead-wire outlet only at a portion thereof which lies between the second flange of the first bobbin and the first flange of the second bobbin which are opposed to each other in the axial direction of the starter.

The head of the first coil lead wire extends through a hole formed in the second bobbin toward the second end of the frame in the axial direction of the starter and is, as described above, joined to the power supply terminal installed in the resinous cover.

The above layout of the first coil lead wire, however, results in an increased length of a portion of the first coil lead wire which extends from the end of the lead-wire outlet, in other words, is unretained by the lead-wire outlet, thus resulting in reduction in workability for an operator when assembling the starter, specifically, in a difficulty in passing the head of the first coil lead wire through the hole of the second bobbin.

The first coil lead wire extending from the lead-wire outlet passes outside an air gap in a magnetic circuit of the second solenoid in the axial direction of the starter, so that it is adversely affected by magnetic flux leaking outside the air gap when the second coil is energized following energization of the first coil. Specifically, a magnetic force is exerted on the first coil lead wire by interaction of the electric current flowing through the first coil lead wire and the magnetic field crated by the second coil, so that the first coil lead wire is inclined. This may cause the first coil lead wire to be pressed against a corner of the lead-wire outlet and worn physically, thus leading to damage to an insulating film of the first coil lead wire.

Additionally, cyclic contact of the first coil lead wire with the corner of the lead-wire outlet will result in wear of the corner of the lead-wire outlet, thereby producing abrasion powder which may be a factor causing a malfunction of the first or second solenoid.

Further, the magnetic field produced by the second coil may result in occurrence of noise in the first coil lead wire, which leads to instability in operation of the first solenoid.

SUMMARY OF THE INVENTION

It is therefore an object of this disclosure to provide an electromagnetic switch which is equipped with a first solenoid and a second solenoid and designed to improve the ease with which the first and second solenoids are installed and minimize adverse effects of magnetic force on a lead wire of the first solenoid.

According to one aspect of the invention, there is provided an electromagnetic switch for use in a starter to start an engine which comprises: (a) a frame which has a given length with a first end and a second end opposite the first end, the first end defining a bottom of the frame, the second end having an opening; (b) a first solenoid which includes a first coil which is wound around a first bobbin and disposed closer to the first end of the frame, the first bobbin having a first end facing the first end of the frame and a second end facing the second end of the frame, the first coil working to produce a magnetic force to move a pinion of a starter toward a ring gear of an engine; (c) a second solenoid which includes a second coil which is wound around a second bobbin and disposed closer to the second end of the frame than the first bobbin is, the second bobbin having a first end facing the first end of the frame and a second end facing the second end of the frame, the second coil working to produce a magnetic force to close main contacts installed in a power supply circuit for an electric motor which serves to rotate the pinion; (d) first and second lead wires extending from the first coil outside the second end of the first bobbin, at least the first lead wire passing radially inside an inner periphery of the second coil and extending toward the second end of the frame; and (e) a lead-wire retainer which extends from the second end of the first bobbin in an axial direction of the first bobbin at least to a location of an air gap formed in a magnetic circuit of the second solenoid.

A portion of the first lead wire is, therefore, held by the lead-wire retainer at least in a range between the second end of the first bobbin and the air gap, thereby enabling a portion of the first lead wire of the first coil which extends outside the lead-wire retainer, in other words, which is not held by the lead-wire retainer to be shortened as compared with the prior art structure, as discussed in the introductory part of this application. This minimizes the inclination or deflection of the first lead wire when the first solenoid and the second solenoid are fabricated within the frame, thus facilitating the ease with which the first and second solenoids are mounted in place in the frame.

When the second coil is excited following excitation of the first coil, it will cause a magnetic force to be exerted on the first lead wire by interaction of the electric current flowing through the first lead wire and the magnetic field crated by the second coil. The first lead wire, as described above, has the portion physically supported by the lead-wire retainer at least in the range between the second end of the first bobbin and the air gap, thereby resulting in a decrease in adverse effects of the magnetic force on the first lead wire of the first coil, which minimizes the inclination or deflection of the first lead wire.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 2(*b*) is a front view of lead-wire guides secured to the SL1 bobbin in FIG. 2(*a*);

FIG. 3(*b*) is a front view of lead-wire guides secured to the SL1 bobbin in FIG. 3(*a*);

FIG. 4(*b*) is a front view of lead-wire guides secured to the SL1 bobbin in FIG. 4(*a*);

DESCRIPTION OF THE PREFERRED EMBODIMENTS

Figure 1:
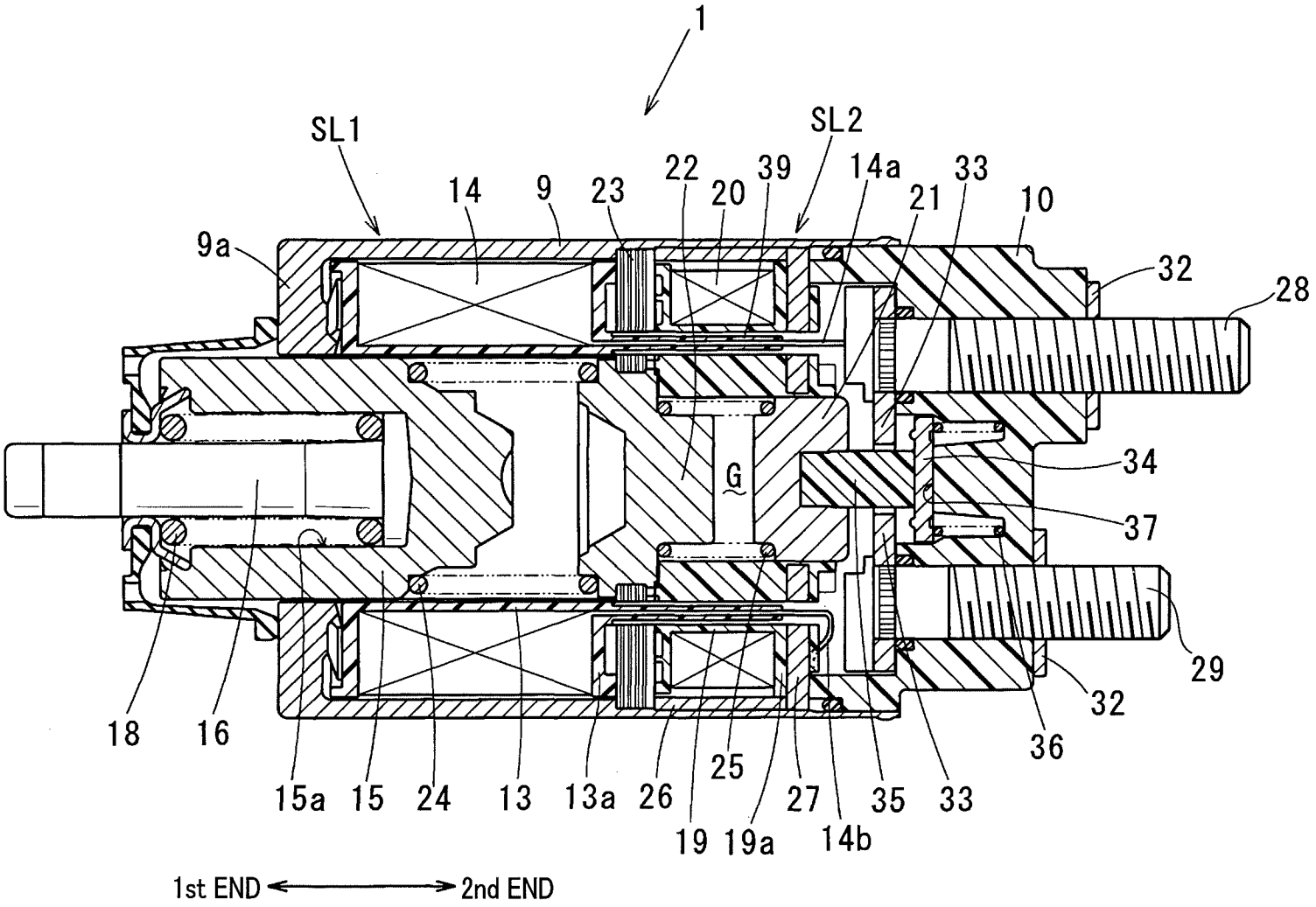
FIG. 1 is a partially cross sectional view which shows the structure of an electromagnetic switch according to the first embodiment.

Referring to the drawings, wherein like reference numbers refer to like parts in several views, particularly to FIG. 1, there is shown an electromagnetic switch 1 according to the first embodiment. The electromagnetic switch 1, as referred to therein, is used with a starter 2 illustrated in FIG. 5 engineered to start an internal combustion engine 100 mounted in an automotive vehicle equipped with an automatic engine stop/restart system (also called an idle stop system). The automatic engine stop/restart system works to stop injecting fuel into the engine 100 to automatically stop the engine 100 when the vehicle has temporarily stopped at a red light at an intersection or by a traffic jam on a road.

Figure 5:
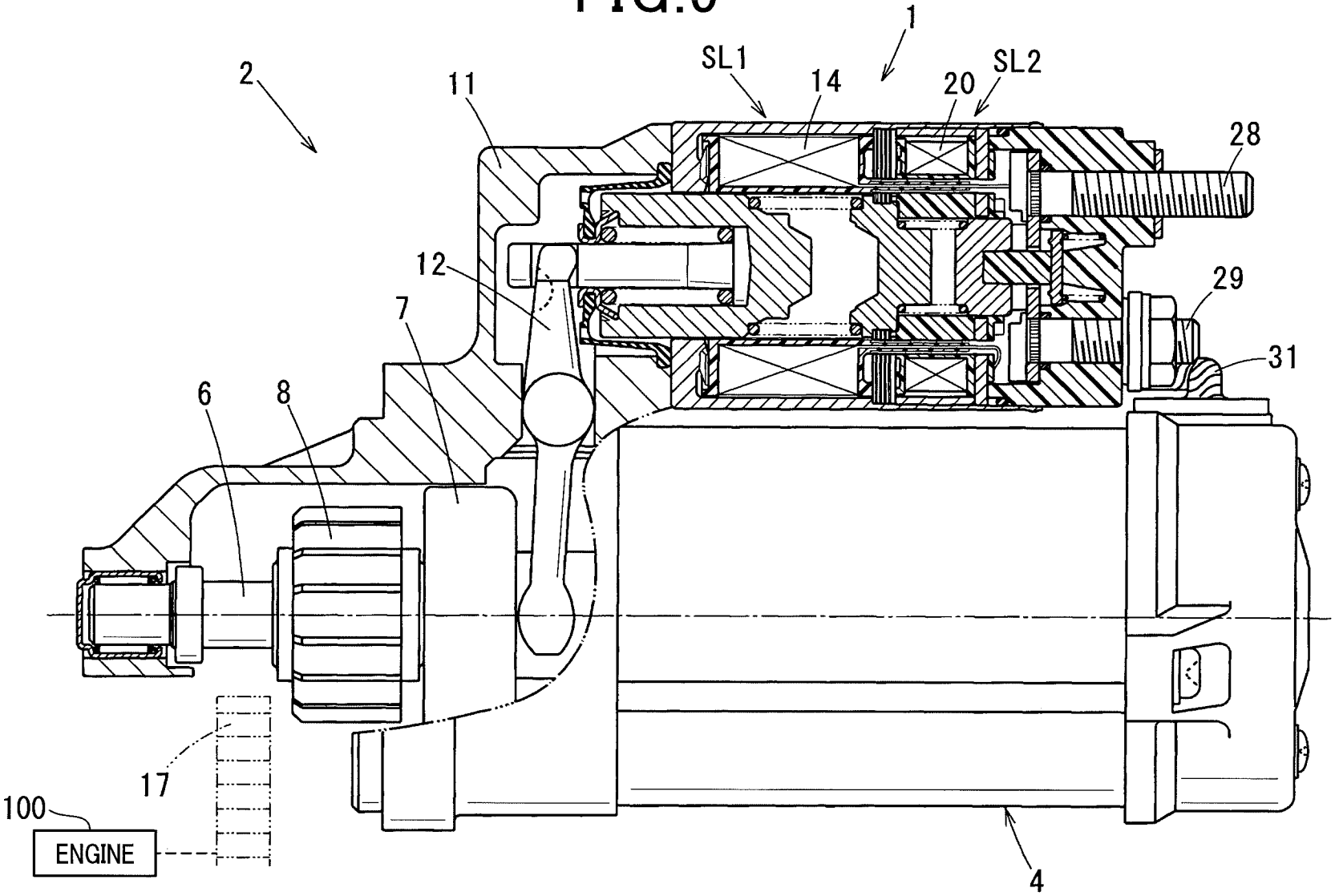
FIG. 5 is a partially sectional view which illustrates a starter in which the electromagnetic switch of FIG. 1 is installed.
Figure 6:
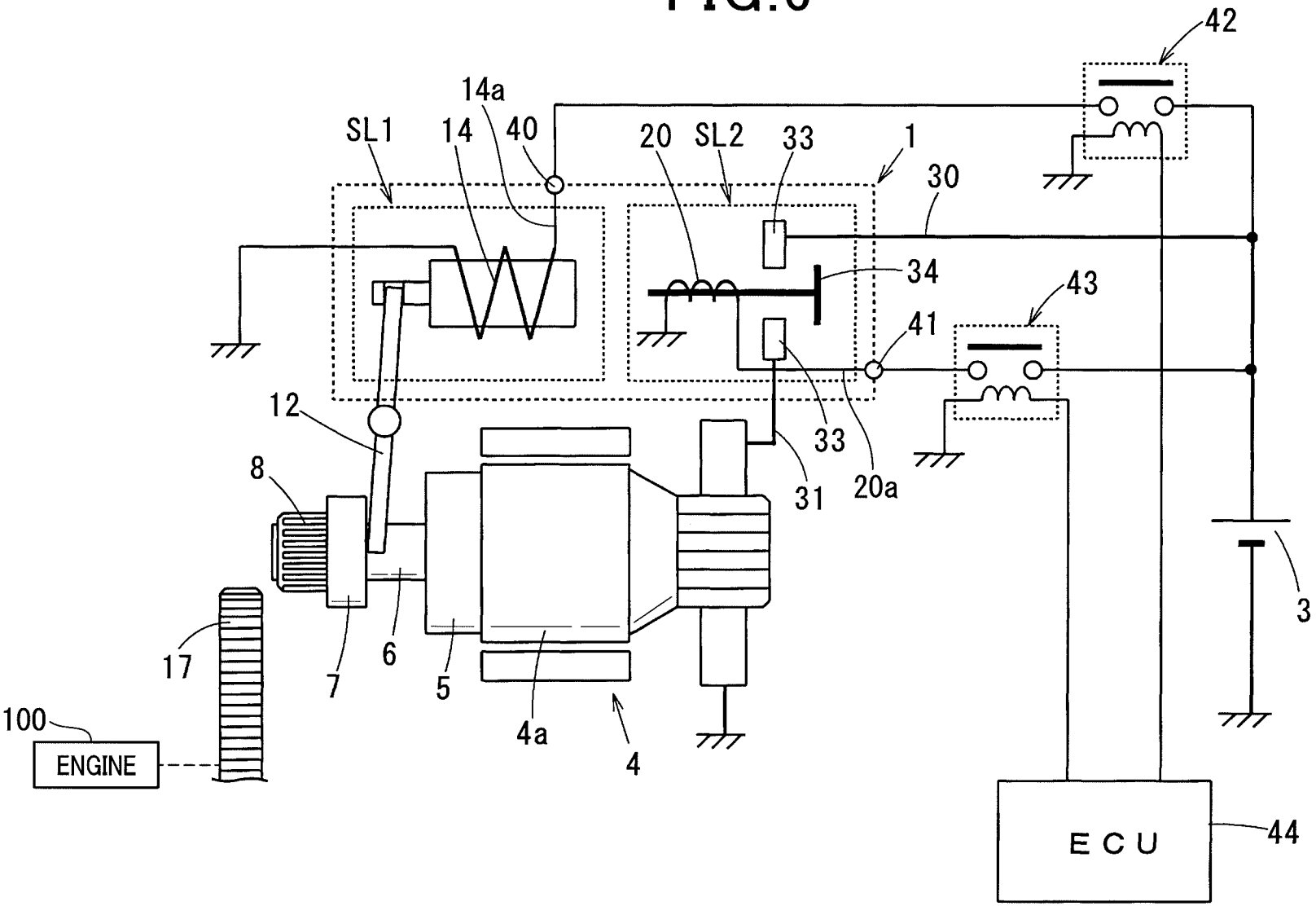
FIG. 6 is a block diagram which illustrates a structure of an electric circuit of the starter of FIG. 5.

The starter 2 includes, as illustrated in FIGS. 5 and 6, the electric motor 4, the output shaft 6, the pinion 8, and the electromagnetic switch 1. The electric motor 4 is supplied with electric power from the battery 3 and produces torque on the armature 4*a*. The torque is then transmitted to the output shaft 6 through the speed reducer 5. The pinion 8 is installed on the output shaft 6 along with the clutch 7.

The electromagnetic switch 1, as illustrated in FIG. 1, has the frame 9 (i.e., a housing), a solenoid unit (which will be discussed later in detail) disposed inside the frame 9, main contacts (which will be discussed later in detail) disposed in a power supply circuit for the motor 4, and the resinous cover 10. The frame 9*a* is hollow cylindrical and has a given length with two ends opposed to each other in an axial direction of the electromagnetic switch 1. A left one of the ends, as viewed in the drawing, forms the annular bottom 9*a* (which will also be referred to as a first end below), while the right end has an opening (which will also be referred to as a second end below). The resinous cover 10 is attached to the right end of the frame 9 to close the opening of the frame 9. The power supply circuit for the motor 4 is, as can be seen in FIG. 6, a power supply line through which current is supplied from the battery 3 to the motor 4. The supply of current to the motor 4 is established or blocked by closing or opening the main contacts.

The frame 9 serves as an outer shell of the electromagnetic switch 1 and also functions as a magnetic circuit of the solenoid unit. The frame 9 is secured to the housing 11 of the starter 2 using two stud bolts (not shown). The frame 9 has an outer diameter which is constant from the left end (i.e., the bottom 9*a*) to the right end opposed to the left end (i.e., the opening) in the axial direction of the starter 2 (i.e., the frame 9). The frame 9 has a cylindrical peripheral wall whose thickness at the right side (i.e., closer to the opening), as can be seen in FIGS. 1 and 5, smaller than that at the left side (i.e., closer to the bottom 9*a*).

The solenoid unit is, as illustrated in FIGS. 1 and 5, made up of the first solenoid SL1 and the second solenoid SL2. The first solenoid SL1 works to move the pinion 8 through the shift lever 12 away from the motor 4 (i.e., leftward, as viewed in the drawings) along with the clutch 7. The second solenoid SL2 works to open or close the main contacts. The first solenoid SL1 and the second solenoid SL2 are disposed in series in alignment with each other in the axial direction of the electromagnetic switch 1 (i.e., the lateral direction in FIGS. 1 and 5).

The first solenoid SL1 includes the first coil 14 and a first movable iron core working as the SL1 plunger 15. The first coil 14 (which will also be referred to as an SL1 coil 14 below) is made of wire wound around the resinous bobbin 13 and located closer to the first end (i.e., the bottom 9*a*) of the frame 9. The bobbin 13 will also be referred to as a first bobbin or SL1 bobbin below. The SL1 plunger 15 is movable in the axial direction of the electromagnetic switch 1 inside the inner periphery of the SL1 coil 14.

The SL1 plunger 15 is hollow cylinder and has the cylindrical hole 15*a* formed in the longitudinal center thereof. The cylindrical hole 15*a* opens at a left one of ends of the SL1 plunger 15, as viewed in FIG. 1 and has a bottom surface on the other end. The joint 16 and the drive spring 18 are disposed inside the cylindrical hole 15*a*. The joint 16 works to transmit the movement of the SL1 plunger 15 to the shift lever 12. The drive spring 18 works to store a reactive force which brings the pinion 8, as illustrated in FIG. 5, into engagement with the ring gear 17 coupled to the engine 100 mounted in the automotive vehicle.

The second solenoid SL2 includes the second coil 20 and a second movable iron core working as the SL2 plunger 21. The second coil 20 (which will also be referred to as an SL2 coil 20 below) is made of wire wound around the resinous bobbin 19 and located closer to the second end (i.e., the opening) of the frame 9. The bobbin 19 will also be referred to as a second bobbin or SL2 bobbin below. The SL2 plunger 21 is movable in the axial direction of the electromagnetic switch 1 inside the inner periphery of the SL2 coil 20.

The fixed iron core 22 is disposed between the first plunger 15 and the second plunger 21 and shared with the first solenoid SL1 and the second solenoid SL2.

The fixed iron core 22 is mechanically and magnetically joined to the plate core 23 arranged between the SL1 coil 14 and the SL2 coil 20.

The plate core 22 is made of a stack of a plurality of iron plates pressed into, for example, an annular shape and serves to magnetically couple between the frame and the fixed iron core 22 to form a magnetic flux path. The plate core 22 may alternatively be formed by a single thick plate made of a magnetic material such as iron.

The return spring 24 is disposed between the fixed iron core 22 and the first plunger 15 to urge the first plunger 15 away from the fixed iron core 22. Similarly, the return spring 25 is disposed between the fixed iron core 22 and the second plunger 21 to urge the second plunger 21 away from the fixed iron core 22.

The cylindrical sub-yoke 26 is disposed outside the outer periphery of the SL2 coil 20, as viewed in a radial direction of the SL2 coil 20. The disc-shaped magnetic plate 27 is disposed on a right one of ends of the SL2 coil 20, as viewed in FIG. 1, which will also be referred to as a second end below.

The sub-yoke 26 is fit in an inner periphery of a thin walled portion (i.e., the right side in FIG. 1 or 5) of the peripheral wall of the frame 9 and couples between the plate core 23 and the magnetic plate 27 to form a magnetic flux path extending in the axial direction of the electromagnetic switch 1. The SL2 bobbin 19 has two flanges: one will be referred to below as a first flange facing the first end (i.e., the left side, as viewed in FIG. 1) of the frame 19, and the second will be referred to below as a second flange 19*a* facing the second end (i.e., the right side, as viewed in FIG. 1) of the frame 19. The magnetic plate 27 is insert-molded with the second flange 19*a* of the SL2 bobbin 19 and extends in a direction perpendicular to the axial direction of the SL2 coil 20 to form a magnetic flux path among the frame 9, the sub-yoke 26, and the second plunger 21. The magnetic plate 27 is of an annular shape with a center hole through which the second plunger 21 is movable in the axial direction thereof.

The resinous cover 10 is, as illustrated in FIG. 1, inserted into an opening formed in the second end of the frame 9 through a seal such as an O-ring and secured in contact with an inner periphery of the second end of the frame 9 by swaging or crimping the peripheral wall of the second end of the frame 9. The resinous cover 10 has two terminal bolts 28 and 29 mounted therein.

The terminal bolt 28 is usually called a B-terminal bolt to which the battery cable 30, as shown in FIG. 6, is joined. The terminal bolt 29 is usually called an M-terminal bolt to which the lead 31, as shown in FIGS. 5 and 6, extending from the motor 4 is joined. The terminal bolts 28 and 29 are inserted into through-holes formed in the resinous cover 10 and secured to the resinous cover 10 using washers 32 illustrated in FIG. 1.

The above described main contacts include three contacts: a pair of fixed contacts 33 and a single moving contact 34 which are disposed inside the resinous cover 10. The fixed contacts 33 are mechanically and electrically connected to the terminal bolts 28 and 29, respectively.

The moving contact 34 is retained on the end surface of the plunger shaft 35 fit in the second plunger 21. Specifically, the moving contact 34 is urged by a spring load produced by the contact press spring 36 against the end surface of the plunger shaft 35. The spring load created by the contact press spring 36 is set smaller than that produced by the return spring 25. In operation, when the SL2 coil 20 is deenergized, the moving contact 34 is, as illustrated in FIG. 1, urged against the reactive force produced by the contact press spring 36 into contact with the contact seat 37 formed on an inner wall of the resinous cover 10, so that it is separate from the fixed contacts 33 (i.e., an off-state of the main contacts).

The layout of lead wires of the SL1 coil 14 and the SL2 coil 20 will be described below.

Figure 2A:
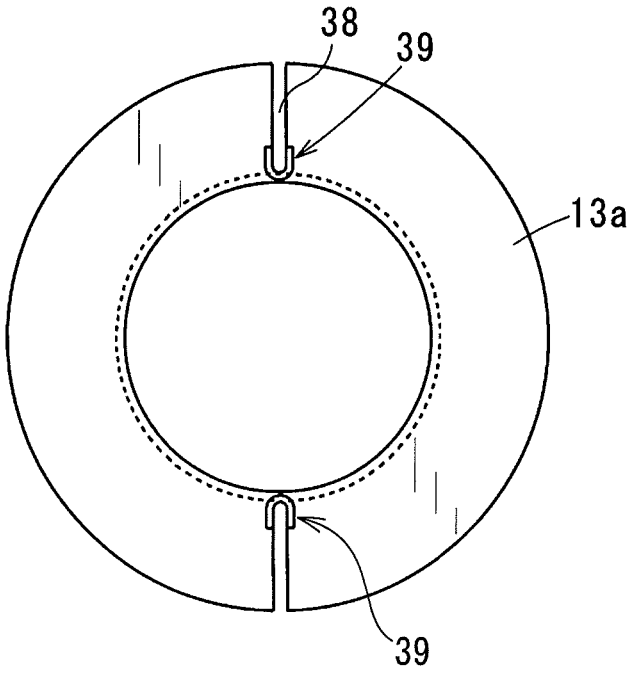
FIG. 2(*a*) is a plane view which illustrates an SL1 bobbin installed in the electromagnetic switch of FIG. 1.
Figure 2B:
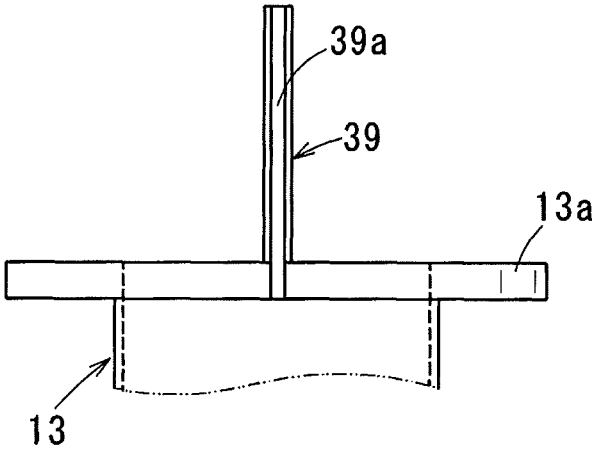
Figure 3A:
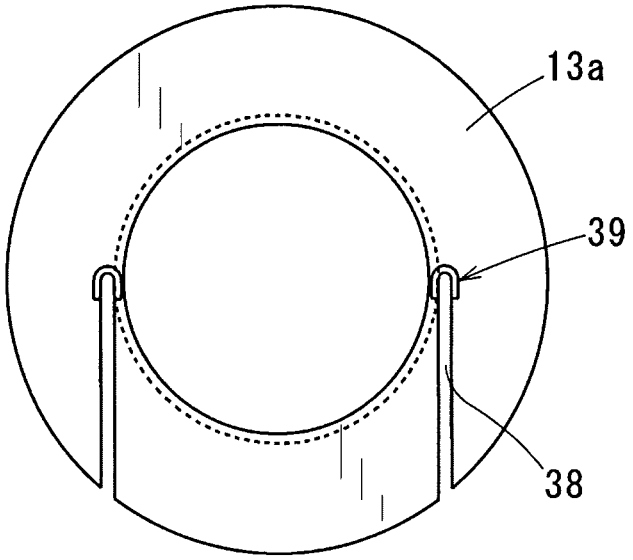
FIG. 3(*a*) is a plane view which illustrates a modified form of an SL1 bobbin installed in the electromagnetic switch of FIG. 1.
Figure 3B:
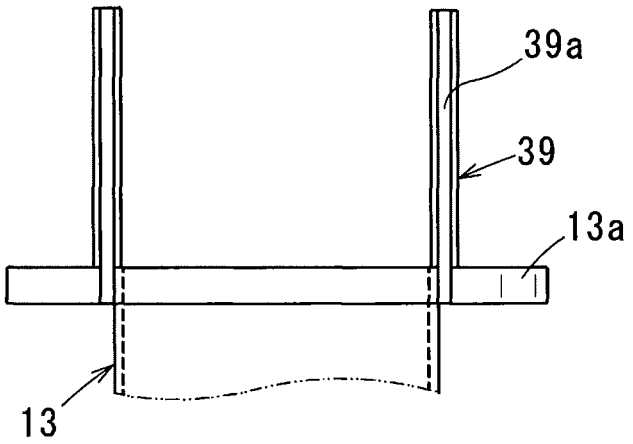
Figure 4A:
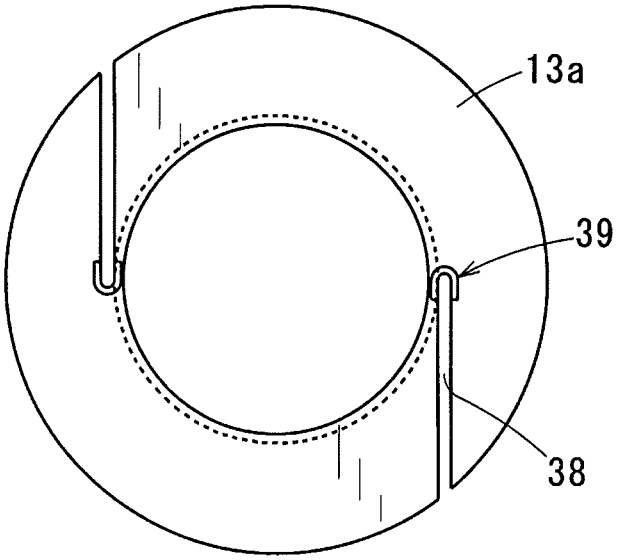
FIG. 4(*a*) is a plane view which illustrates a second modified form of an SL1 bobbin installed in the electromagnetic switch of FIG. 1.
Figure 4B:
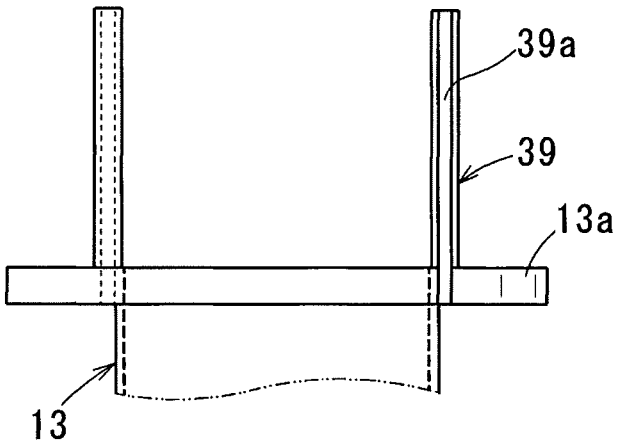

The SL1 coil 14 has, as illustrated in FIG. 1, two lead wires 14*a* and 14*b*: one being a winding start end of a wire of the SL1 coil 14, and the second being a winding trailing end of the wire. The lead wire 14*a* will also be referred to as a first lead wire, while the lead wire 14*b* will also be referred to as a second lead wire below. The lead wires 14*a* and 14*b* extending from the SL1 coil 14 pass through two wire-outlet grooves 38, as illustrated in FIGS. 2(*a*) and 2(*b*), formed in the second flange 13*a* of the SL1 bobbin 13 outside the bobbin 13. The wire-outlet grooves 38 are, as can be seen in FIG. 2(*a*), formed by slits which are diametrically opposed to each other in the radial direction of the second flange 13*a* and extend from an outer circumferential edge of the second flange 13*a* inwardly in the radial direction of the second flange 13*a*. The wire-outlet grooves 38 may alternatively be, as illustrated in FIGS. 3(*a*) and 3(*b*), shaped so as to extend in the same direction in which a line tangent to the inner periphery of the SL1 bobbin 13 extends. The wire-outlet grooves 38 may also be, as illustrated in FIGS. 4(*a*) and 4(*b*), shaped so as to extend in opposite directions in which the line tangent to the inner periphery of the SL1 bobbin 13 extends.

The lead wires 14*a* and 14*b* extending outside the SL1 bobbin 13 are retained by lead-wire guides 39, as will be described later in detail, inside the inner periphery of the SL2 coil 20, so that they extend substantially straight toward the second end of the frame 9. The lead wire 14*a* that is, for example, the winding start end of the wire of the SL1 coil 14 is joined to an SL1 power supply terminal 40 illustrated in FIG. 6. The lead wire 14*b* that is, for example, the winding trailing end of the wire of the SL1 coil 14 is mechanically and electrically joined to the surface of the magnetic plate 27, that is, connected to ground through the frame 9.

The SL2 coil 20, like the SL1 coil 14, two lead wires (not shown): one being a winding start end of a wire of the SL2 coil 20, and the second being a winding trailing end of the wire. The two lead wires extending from the SL2 coil 20 pass through two wire-outlet grooves (not shown) formed in the second flange 19*a* of the SL2 bobbin 19 outside the SL2 bobbin 19. The wire-outlet grooves of the second flange 19*a* are, like the wire-outlet grooves 38 of the second flange 13*a* of the SL1 bobbin 13, defined by slits which are diametrically opposed to each other in the radial direction of the second flange 19*a* and extend from an outer circumferential edge of the second flange 19*a* inwardly in the radial direction of the second flange 19*a*.

One of the two lead wires extending outside the SL2 bobbin 19, for example, a winding start end, as indicated by a reference number 20*a* in FIG. 6) of wire of the SL2 coil 20 is joined to an SL2 power supply terminal 41 illustrated in FIG. 6. The other lead wire, for example, a winding trailing end of the wire of the SL2 coil 20 is mechanically and electrically joined to the surface of the magnetic plate 27.

The SL1 power supply terminal 40 and the SL2 power supply terminal 41 pass through the bottom of the resinous cover 10, in other words, are retained by the resinous cover 10 and connect, as can be seen in FIG. 6, with the battery 3 through the SL1 relay 42 and the SL2 relay 43.

The lead-wire guides 39 serve as lead-wire retainers and are formed by resin integrally with the second flange 13*a* of the SL1 bobbin 13. The lead-wire guides 39 extend from radially innermost ends (i.e., bottoms) of the wire-outlet grooves 38 in an axial direction of the second flange 13*a*, that is, a direction perpendicular to a major surface of the second flange 13*a*. Each of the lead-wire guides 39 may alternatively be made as a single piece member and joined to or fit in the second flange 13*a* of the SL1 bobbin 13. Each of the lead-wire guides 39 is, as illustrated in FIG. 2(*a*), of a U-shape in cross section contoured to conform with the periphery of a radially innermost end portion of one of the wire-outlet grooves 38 and has defined therein a U-shaped lead-wire retaining groove 39*a*, as clearly illustrated in FIG. 2(*b*), in which one of the lead wire 14*a* and 14*b* of the SL1 coil 14 is held and directed in a direction perpendicular to the major surface of the second flange 13*a* of the SL1 bobbin 13 (i.e., a vertical direction, as viewed I FIG. 2(*b*)).

The SL1 coil 14 (i.e., the SL1 bobbin 13) and the SL2 coil 20 (i.e., the SL2 bobbin 19) are aligned with each other in the axial direction (i.e., the longitudinal direction) of the electromagnetic switch 1. Each of the lead-wire guides 39 extends, as clearly illustrated in FIG. 1, over an axial position of the air gap G formed in the magnetic circuit of the solenoid SL2 (which will also be referred to as an air gap position below) to have a tip located at an axial position of the second flange 19*a* of the SL2 bobbin 19. In other words, each of the lead-wire guides 39 extends from the second flange 13*a* of the SL1 bobbin 13 in a direction substantially parallel to the axial direction of the electromagnetic switch 1 (i.e., the axial direction of the second flange 13*a* of the SL1 bobbin 13), passes the air gap G, and reaches the second flange 19*a* of the SL2 bobbin 19. The air gap G is a space created between the fixed iron core 22 and the second plunger 21 when the SL2 coil 20 is in the unexcited state and lies in a range between the ends of the SL2 coil 20 opposed to each other in the axial direction thereof.

The plate core 23 and the SL2 bobbin 19 have formed therein, as can be seen in FIG. 1, through-holes through which the lead-wire guides 39 pass in the axial direction of the plate core 23 and the SL2 bobbin 19. The through-holes formed in the SL2 bobbin 19 extend in the axial direction of the magnetic plate which is insert-molded with the second flange 19*a* of the SL2 bobbin 19 and pass through a thickness of the magnetic plate 27. The through-holes of the SL2 bobbin 19 also extend, as clearly illustrated in FIG. 1, inside the inner circumference of the SL2 coil 20 in the axial direction of the SL2 coil 20.

The operation of the starter 2 will be described below.

The operation of the starter 2 is controlled by the ECU (Electronic Control Unit) 44 designed for use in the automatic engine stop/restart system.

When an engine restart request is made after the automatic engine stop/restart mode (also called the idle stop mode) is entered, the ECU 44 is capable of controlling the operations of the solenoids SL1 and SL2 independently from each other as a function of the speed of the engine 100 at the time when the engine restart request is made. In the following discussion, it is assumed that the speed of the engine 100 upon the request of engine restart is low (e.g., less than or equal to 400 rpm).

The ECU 44 starts to excite the solenoid SL1 prior to the solenoid SL2 in response to the engine restart request. Specifically, the ECU 44 turns on the SL1 relay 42 before the SL2 relay 43.

When the SL1 relay 42 is turned on by the ECU 44, it will cause the power to be supplied from the battery 3 to the SL1 power supply terminal 40, so that the SL1 coil 14 connected to the SL1 power supply terminal 40 is excited. This causes the fixed iron core 22 to be magnetized to produce a magnetic attraction to move the SL1 plunger 15 linearly toward the second end of the frame 9 in the axial direction thereof, thereby thrusting the pinion 8 through the shift lever 12 away from the motor 4 along with the clutch 7.

After the end surface of the pinion 8 hits the end surface of the ring gear 17, when the rotating ring gear 17 has rotated and reached to an angular position where it is enabled to mesh with the pinion 8, the pinion 8 is thrusted by an extensive pressure (i.e., a reactive force) stored in the drive spring 18 into engagement with the ring gear 17.

When the ECU 44 turns on the SL2 relay 43, it will cause the power to be supplied from the battery 3 to the SL2 power supply terminal 41, so that the SL2 coil 20 connected to the SL2 power supply terminal 41 is excited. This causes the fixed iron core 22 to be magnetized to produce a magnetic attraction to move the SL2 plunger 21 linearly toward the second end of the frame 9 in the axial direction thereof, thereby bringing the moving contact 34 against the pressure, as produced by the contact press spring 36, into contact with the fixed contacts 33 to closer the main contacts. The electric power is, thus, supplied from the battery 3 to the motor 4, so that the armature 4*a* produces torque. The torque is then amplified by the speed reducer 5 and transmitted to the output shaft 6 and to the pinion 8 through the clutch 7.

The pinion 8, as described above, has already meshed with the ring gear 17, so that the torque is transmitted from the pinion 8 to the ring gear 17 to crank the engine 100.

The above structure of the electromagnetic switch 1 offers the following beneficial advantages.

1) The electromagnetic switch 1 is, as described above, equipped with the lead-wire guides 39 which hold the lead wires 14*a* and 14*b* of the SL1 coil 14. Each of the lead-wire guides 39 works as a retainer and extends from the second flange 13*a* of the SL1 bobbin 13 in the axial direction of the second flange 13*a* (i.e., the axial direction of the second flange 19*a* of the SL2 bobbin 19) over the air gap G of the solenoid SL2 to have the tip located at the second flange 19*a*. In other words, a portion of the length of each of the lead wires 14*a* and 14*b* which corresponds to a distance between the second flange 13*a* of the SL1 bobbin 13 and the second flange 19*a* of the SL2 bobbin 19 in the axial direction of the SL1 bobbin 13 and the SL2 bobbin 19 is retained by a corresponding one of the lead-wire guides 39. This enhances the stability in installing the solenoid SL1 and the solenoid SL2 in place within the frame 9. Specifically, the front portions of the lead wires 14*a* and 14*b* hardly swing, thus facilitating the ease with which the solenoids SL1 and SL2 are fabricated in the frame 9.
2) When the SL2 coil 20 is excited following excitation of the SL1 coil 14, it will cause a magnetic force to be exerted on the lead wires 14*a* and 14*b* by interaction of the electric current flowing through the lead wires 14*a* and 14*b* and the magnetic field crated by the SL2 coil 20. Each of the lead wires 14*a* and 14*b*, as described above, has a portion retained by one of the lead-wire guides 39 in a range of a distance between the second flange 13*a* of the SL1 bobbin 13 and the second flange 19*a* of the SL2 bobbin 19 in the axial direction of the SL1 bobbin 13 and the SL2 bobbin 19. This results in a decrease in adverse effects of the magnetic force on the lead wires 14*a* and 14*b*, thereby minimizing the inclination of the lead wires 14*a* and 14*b*. This leads to a decreased possibility that the lead wires 14*a* and 14*b* scrape against top edges of the lead-wire retaining groove 39*a* of the lead-wire guides 39 which would cause damage to insulating films of the lead wires 14*a* and 14*b*.
3) The decrease in inclination of the lead wires 14*a* and 14*b* caused by the magnetic force results in a decrease in physical wear of the top edges of the lead-wire retaining grooves 39*a* of the lead-wire guides 39, thus minimizing abrasion powder which arises from the wear of the top edges of the lead-wire retaining grooves 39*a* and will be a factor causing a malfunction of the solenoid SL1 or SL2.
4) The lead wires 14*a* and 14*b* of the SL1 coil 14 are, as described above, retained by the lead-wire guides 39 at the location of the air gap G of the solenoid SL2, thus reducing adverse effects of the magnetic field created at the SL2 solenoid 20 on the lead wires 14*a* and 14*b*, which minimizes the possibility of noises superimposed on the lead wires 14*a* and 14*b*.

Second Embodiment

Figure 7:
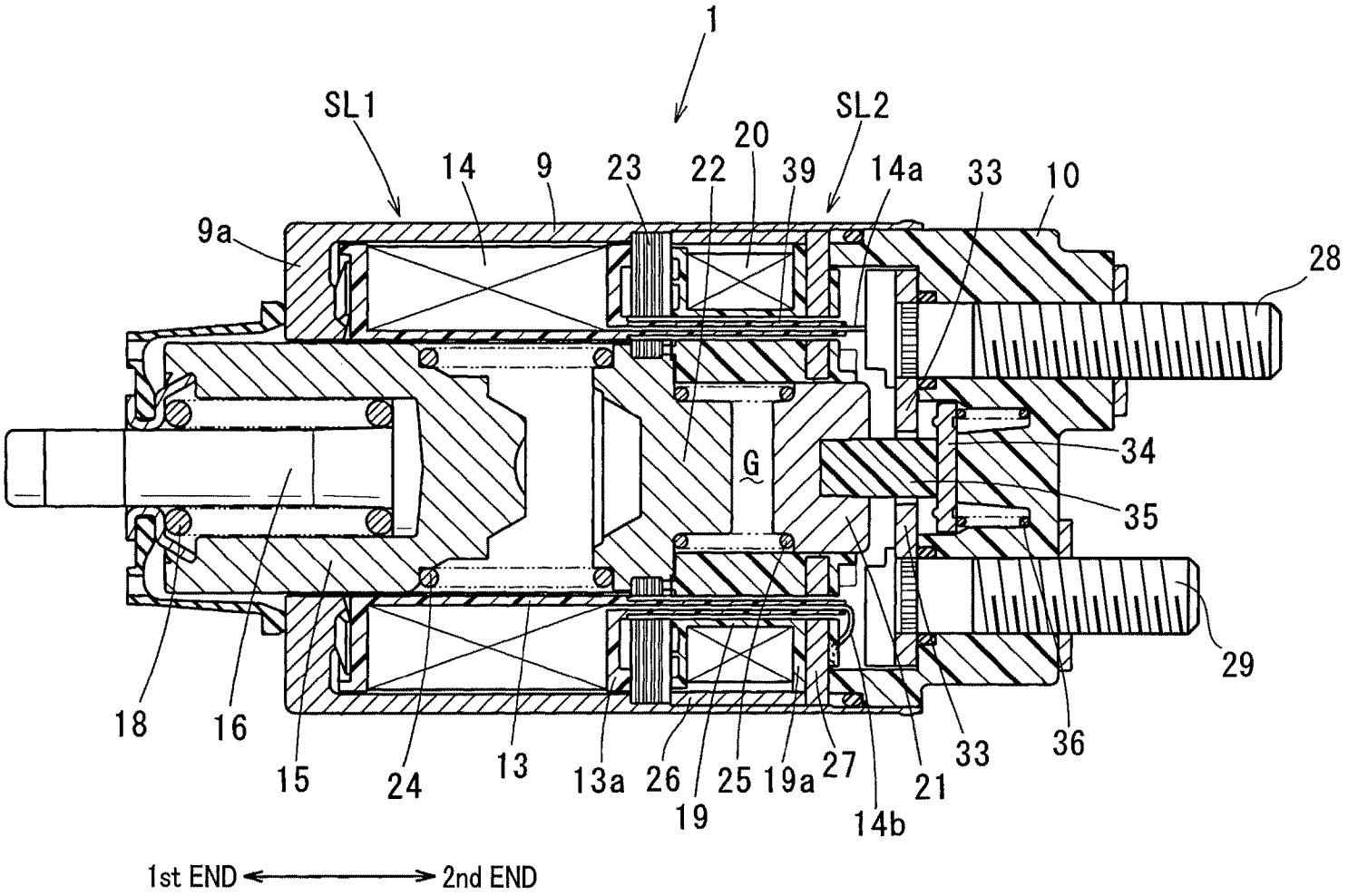
FIG. 7 is a partially cross sectional view which shows the structure of an electromagnetic switch according to the second embodiment.

FIG. 7 illustrates the electromagnetic switch 1 according to the second embodiment. The same reference numbers as employed in the first embodiment will refer to the same parts, and explanation thereof in detail will be omitted here.

The electromagnetic switch 1 has the lead-wire guides 39 extending from the second flange 13*a* of the SL1 bobbin 13 in the axial direction of the second flange 13*a* over the outside surface of the second flange 19*a* of the SL2 bobbin 19 to have the tips thereof located closer to the second end of the frame 9 than the second flange 19*a* is.

Accordingly, the length of the lead-wire guides 39 extending in the axial direction of the SL1 bobbin 13 is longer than that in the first embodiment, thus resulting in a decrease in length of portions of the lead wires 14*a* and 14*b* which extend outside the tip ends of the lead-wire guides 39. This further enhances the stability in installing the solenoids SL1 and SL2 within the frame 9.

The distance between the air gap G of the solenoid SL2 and the tips of the lead-wire guides 39 in the axial direction of the electromagnetic switch 1 is also increased as compared with the first embodiment, thereby further decreasing the adverse effects of the magnetic force on the lead wires 14*a* and 14*b* of the SL1 coil 14, which minimizes the inclination of the lead wires 14*a* and 14*b*.

Third Embodiment

Figure 8:
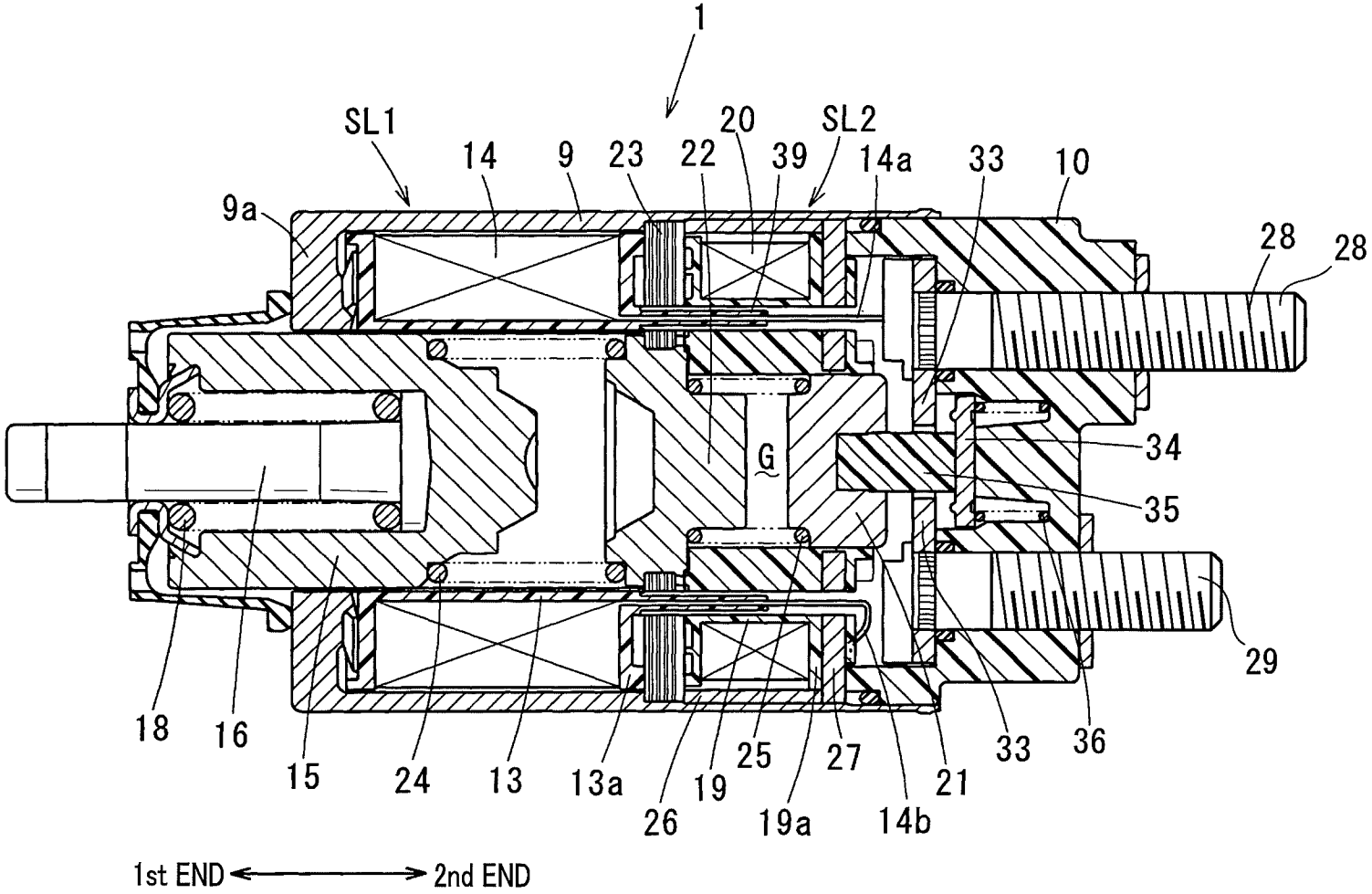
FIG. 8 is a partially cross sectional view which shows the structure of an electromagnetic switch according to the third embodiment.

FIG. 8 illustrates the electromagnetic switch 1 according to the third embodiment. The same reference numbers as employed in the first embodiment will refer to the same parts, and explanation thereof in detail will be omitted here.

The electromagnetic switch 1 has the lead-wire guides 39 extending from the second flange 13*a* of the SL1 bobbin 13 in the axial direction of the second flange 13*a* to have the tips thereof located at the air gap G of the solenoid SL2.

The length of the lead-wire guides 39 extending in the axial direction of the SL1 bobbin 13 is, therefore, shorter than that in the first and second embodiments, but however, the lead wires 14*a* and 14*b* of the SL1 coil 14 are supported by the lead-wire guides 39 between the second flange 13*a* of the SL1 bobbin 13 and the air gap G of the solenoid SL2, thus decreasing the adverse effects of the magnetic force on the lead wires 14*a* and 14*b* of the SL1 coil 14 which will lead to the inclination of the lead wires 14*a* and 14*b*, as compared with the prior art structure discussed in the introductory part of this application.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modifications to the shown embodiment which can be embodied without departing from the principle of the invention as set forth in the appended claims.

For instance, the electromagnetic switch 1 of each of the first to third embodiments is designed so that the direction in which the SL1 plunger 15 is attracted by the fixed iron core 22 is opposite the direction in which the SL2 plunger 21 is attracted by the fixed iron core 22, but however, may be engineered to have the SL1 plunger 15 and the SL2 plunger 21 moving in the same direction.

The lead wires 14*a* and 14*b* of the SL1 coil 14 installed in the electromagnetic switch 1 in FIGS. 1, 7, and 8, as described above, both pass radially inside the inner periphery of the SL2 coil 20 toward the second end of the frame 9, however, only the lead wire 14*a* may alternatively be retained by the lead-wire guide 39 and extend inside the inner periphery of the SL2 coil 20 toward the second end of the frame 9, while the lead wire 14*b* may be grounded to the surface of the plate core 23.

What is claimed is:

1. An electromagnetic switch for use in a starter to start an engine comprising:

a frame which has a given length with a first end and a second end opposite the first end, the first end defining a bottom of the frame, the second end having an opening;

a first solenoid which includes a first coil which is wound around a first bobbin and disposed closer to the first end of the frame, the first bobbin having a first end facing the first end of the frame and a second end facing the second end of the frame, the first coil working to produce a magnetic force to move a pinion of a starter toward a ring gear of an engine;

a second solenoid which includes a second coil which is wound around a second bobbin and disposed closer to the second end of the frame than the first bobbin is, the second bobbin having a first end facing the first end of the frame and a second end facing the second end of the frame, the second coil working to produce a magnetic force to close main contacts installed in a power supply circuit for an electric motor which serves to rotate the pinion;

first and second lead wires extending from the first coil outside the second end of the first bobbin, at least the first lead wire passing radially inside an inner periphery of the second coil and extending toward the second end of the frame; and a lead-wire retainer integral with the first bobbin and which extends from the second end of the first bobbin in an axial direction of the first bobbin at least to a location of an air gap formed radially inside the second solenoid in a magnetic circuit of the second solenoid to retain the first lead wire, wherein the second lead wire of the first coil passes radially inside the inner periphery of the second coil and extends toward the second end of the frame, and further comprising a second lead-wire retainer which retains the second lead wire.

2. An electromagnetic switch as set forth in claim 1, wherein the lead-wire retainer extends from the second end of the first bobbin over the air gap toward the second end of the frame.

3. An electromagnetic switch as set forth in claim 1, wherein the lead-wire retainer extends from the second end of the first bobbin in the axial direction of the first bobbin at least to the second end of the second bobbin.

4. An electromagnetic switch as set forth in claim 1, wherein the lead-wire retainer is formed by a resin integrally with the first bobbin.

5. An electromagnetic switch as set forth in claim 1, wherein the first lead wire of the first coil connects with a power supply terminal to which electric current is supplied from an external power supply to excite the first coil, and wherein the second lead wire of the first coil is connected to ground through the frame.

6. An electromagnetic switch as set forth in claim 1, wherein the first coil and the second coil are aligned with each other in an axial direction of the electromagnetic switch, and wherein the lead-wire retainer extends in the axial direction of the electromagnetic switch toward the second end of the frame and retains the first lead wire straight.

7. An electromagnetic switch as set forth in claim 1, wherein the lead-wire retainer has a semi-cylindrical shape covering an outer periphery of the first lead wire and has an opening configured to guide insertion of the first lead wire and is formed in a portion of the second end of the first bobbin other than a periphery of the first bobbin around which the first coil is wound.

* * * * *